US007950959B2

(12) United States Patent
Chen

(10) Patent No.: US 7,950,959 B2
(45) Date of Patent: May 31, 2011

(54) COAXIAL CONNECTOR

(76) Inventor: Ten May Chen, Taipei (TW)

( * ) Notice: Subject to any disclaimer, the term of this patent is extended or adjusted under 35 U.S.C. 154(b) by 324 days.

(21) Appl. No.: 12/173,635

(22) Filed: Jul. 15, 2008

(65) Prior Publication Data

US 2010/0041270 A1 Feb. 18, 2010

(51) Int. Cl.
*H01R 9/05* (2006.01)

(52) U.S. Cl. ..... 439/582

(58) Field of Classification Search ..... 439/582, 439/585, 578

See application file for complete search history.

(56) References Cited

U.S. PATENT DOCUMENTS 6,305,980 B2 * 10/2001 Ko ..... 439/582
6,361,383 B1 * 3/2002 Ko ..... 439/856
6,371,806 B1 * 4/2002 Ko ..... 439/585
6,435,908 B1 * 8/2002 Ko ..... 439/585
6,572,407 B1 * 6/2003 Ko ..... 439/582
7,186,142 B2 * 3/2007 Nagata et al. ..... 439/582
7,367,840 B2 * 5/2008 Chen et al. ..... 439/581
7,581,958 B2 * 9/2009 Swanson et al. ..... 439/63
2006/0084314 A1 * 4/2006 Takizawa ..... 439/352

FOREIGN PATENT DOCUMENTS

CN ZL01264762.4 7/2002

* cited by examiner

*Primary Examiner* — Neil Abrams

(57) ABSTRACT

A coaxial connector includes an insulating body, a central terminal having a main rod comprising front and rear portions, and a housing. The front portion extends outwardly to form left and right wing-members. Wing-members can be bent to surround the front portion and to form a cylindrical contact. Each wing-member extends outwardly to form a sheet body. Tongue members are bendable to form fixing portions for fixing the insulating body by insert molding. The rear portion has fixtures for clamping the coaxial cable. The housing includes a plate member, a main portion for connecting one end of the plate member, and a cable-clamping member for connecting the other end of the plate member. The main portion has two supporting arms for clamping and holding the insulating body. Each supporting arm has a bottom fixture sheet. Side arms and the fixture members are bendable to fix.

9 Claims, 7 Drawing Sheets

COAXIAL CONNECTOR

BACKGROUND OF THE INVENTION

1. Field of the Invention

The present invention relates to a coaxial connector, especially to a coaxial connector in which elements are first mold-formed and then assembled to be a finished article for transmitting high-frequency signals.

2. Description of the Prior Art

A coaxial connector is primarily used to connect a cable with an electronic apparatus to transmit high-frequency signals between them. In order to obtain highly distinct high-frequency signals, the requirements for the structure parts of the coaxial connectors are therefore more critical than usual connectors.

A technology relating to the coaxial connectors can be found in Chinese patent application No. CN 01264762.4, which discloses a coaxial connector consisting of four elements, including an insulating body, a terminal disposed within the insulating body, a housing and a clamping means for fixing and supporting the coaxial connector; wherein the insulating body is composed of two pieces comprising a column member and a base. The terminal is fixed into insulating body by means of secondary assembly. The housing together with the clamping means surround the insulating body and then buckle each other. From the above-described structure of the coaxial connector, it can be found that the insulating body needs two sets of molds to form the two pieces and then assemble them to complete; while the terminal needs another assembly. Likewise, the housing and clamping means need two sets of molds for buckling and assembly. Therefore, the entire assembly process of the coaxial connector needs a plurality of assemblies, such as to cost much time and work and in the mean time reduce the efficiency of the process.

Further, for most coaxial connectors nowadays, their terminals and cables are fixed by means of soldering which may results in an unstable connection between the contact ends of the terminals, as such a more complicated process needed. Please refer to the structure as shown in FIG. 1, the terminal 30 is assembled in the coaxial connector after the insulating body has been fixed onto it, and then the coaxial cable is bound to the end 31 of the terminal 30 by soldering. It needs to take much care while soldering because it may cause short-circuit resulting from the over-heated solder and/or too much solder slag. The solder is small and slippery and it is important to solder tightly when binding the coaxial cable, therefore, there is a routine work to clean the solder slag by using air gun during soldering operation. The soldering process has many disadvantages that cause the finished coaxial connector to be damaged or defective. Moreover, the volume of this type of the coaxial connector is so small as to be more inconvenient and difficult when soldering. The soldering process is also troublesome to operate and may result in the low efficiency of production, high percentage of damaged and/or defective product, more time and work, increased man-made operation, and poor quality control. It is undesirable to use soldering process. Furthermore, the terminal 30 clamps the matched electrical connector with its two contact arms 331 disposed at the opposite position within the connector. By this way, the contact portion is just an arc-surface. This can make the effect of contact deteriorate after frequent plug-in/-out. Therefore, according to the above-mentioned disadvantages of coaxial connector, it is necessary to improve the design of the terminals as to have high quality and efficiency of the signal transmission.

SUMMARY OF THE INVENTION

The main object of the present invention is to provide a coaxial connector, wherein the housing is a one-piece design to simplify assembly, and the product volume is so small as to enhance the ability of anti-electromagnetic interference of the coaxial connector.

Another object of the present invention is to provide a coaxial connector, wherein the cable is fixed by means of clamping in order to improve the difficult of manufacture process, enhance the product quality and production efficiency, and reduce the cost of the production.

Still another object of the present invention is to provide a coaxial connector, wherein its entire terminal is single-process-formed by automatic stamping in order to enhance the efficiency of production.

The present invention provides a coaxial connector, wherein the coaxial connector primarily includes an insulating body, a central terminal and a housing. The insulating body consists of a cylindrical portion and a plate portion, wherein the cylindrical portion consisting of a base and a cylinder protruding from the base. There is a hollow portion in the middle of the cylinder for accommodating the contact of the central terminal. The base is connected with the plate portion and both are on the same plane. A hole penetrating through the plate portion is used to hold the end fixture of the central terminal and thus provides the convenience of manufacture.

The central terminal has a main rod comprising a front portion and a rear portion, wherein the front portion is slightly narrower than the rear portion, and there are left and right wing-members connected each other along the front portion. Said left and right wing-members are symmetrical structures. There are tongue members extended outwardly from the bottoms of the left and right wing-members respectively. Said tongue members can be torn backwardly and then folded to form a fixing portion, which is used to fix the insulating body for receiving terminal. A first notch is formed at the border between the left and right wings; and two second notches are formed respectively between the left and right wing-members and the front portion. Those notches in above-described sites are used to provide a labor-saving effect when the left and right wing-members is bent and folded to surround the front portion and form a cylindrical contact. The contact is formed by the left and right wing-members for connecting the matched connector. There are corner cuts at the external sides of the bottoms of the left and right wing-members. When the left and right wing-members are bent and folded to form the cylindrical contact, a concave notch is formed thereon. The concave notch serves to maintain the stress balance of the terminal when the cylindrical contact is bent toward the main rod and vertical to the front portion. The rear portion has fixtures for clamping the coaxial cable. The fixtures may connect and fix the cable directly by stamping to avoid the above-described problems caused by the soldering of terminals. The central terminal and insulating body are formed by insert molding and therefore are integrated to be one-piece just by a single process.

The housing includes a main portion, a plate portion and a cable-clamping portion. The main portion may have a pair of supporting arms for holding the insulating body. The ends of the supporting arms form a stopper to prevent the insulating body from moving backwardly. The supporting arms have fixture sheet standing oppositely at the edges of the bottoms thereof. The plate portion is composed of the front portion and the rear portion. Both side members of the rear portion may be upwardly and vertically bent and folded to form side arms.

There are inserting ports disposed at suitable positions on the borders between the side arms and the side edges of the rear portion for inserting the fixture sheets. When the main portion is bent and adjacent to the plate portion, the main portion accommodates the cylindrical portion of the insulating body and the supporting arms are received in the rear portion. The fixture sheet passing through the inserting port and the side arms may be bent at their predetermined directions in order to lock-in the insulating body. The coaxial connector of the present invention is easy to assemble. It has high ability of anti-electromagnetic interference and may improve the quality of transmission signals.

Accordingly, an important aspect of the present invention is to design the housing to be one piece and the central terminal to be an integrated form which its one end forms a contact after a plurality of bending and folding steps, and the other end has fixtures for clamping the cable. In addition, the insulating body and the central terminal are formed by insert molding such that the whole coaxial connector may be assembled only by a few bending-folding steps. This may simplify the operations of assembly, improve the difficult of the process, and therefore increase the efficiency of assembly, reduce the cost of production and enhance the signal transmission of the coaxial connector.

The above and other objects, features and advantages of the present invention will become apparent from the following detailed description taken with the accompanying drawings.

DETAILED DESCRIPTION OF THE PREFERRED EMBODIMENTS

The above-described objects, features and advantages of the present invention will be apparent in the following detailed descriptions of the preferred embodiments with reference to the accompanying drawings.

Figure 1:
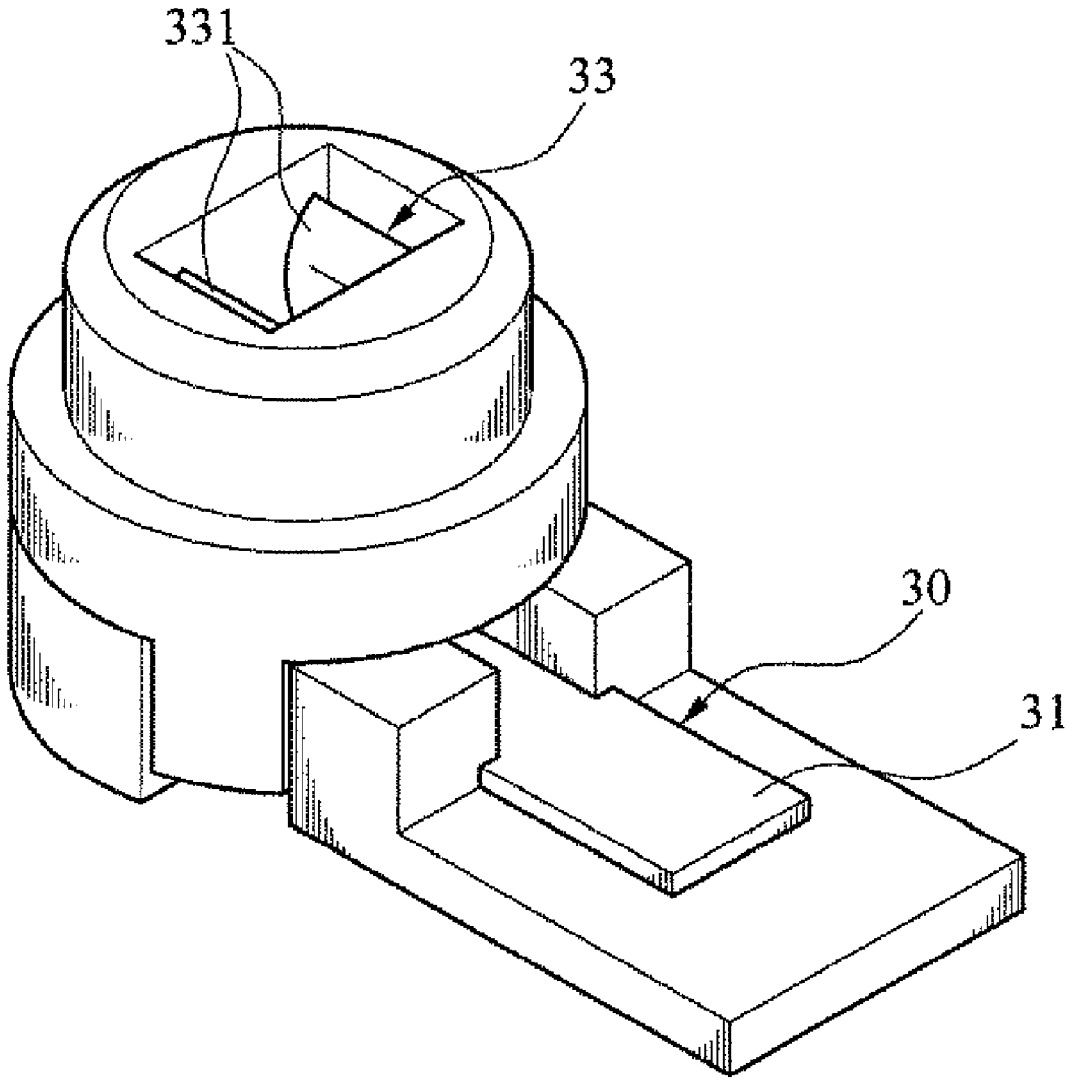
FIG. 1 is a perspective view of a conventional coaxial connector.
Figure 2:
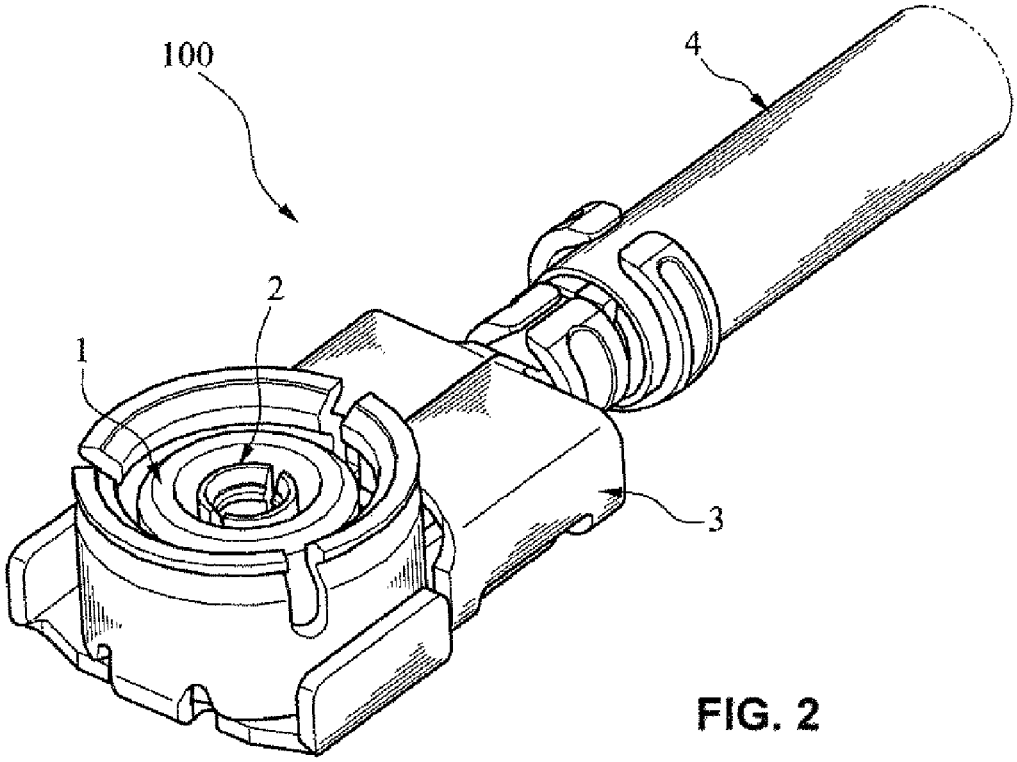
FIG. 2 is a perspective view of the coaxial connector according to the present invention.

Refer to FIG. 2, which shows a preferred embodiment of coaxial connector 100 of the present invention. The coaxial connector 100 comprises an insulating body 1, a central terminal 2 disposed within the insulating body 1, a housing 3 surrounding the insulating body 1, and a coaxial cable 4 connected therewith.

Figure 3:
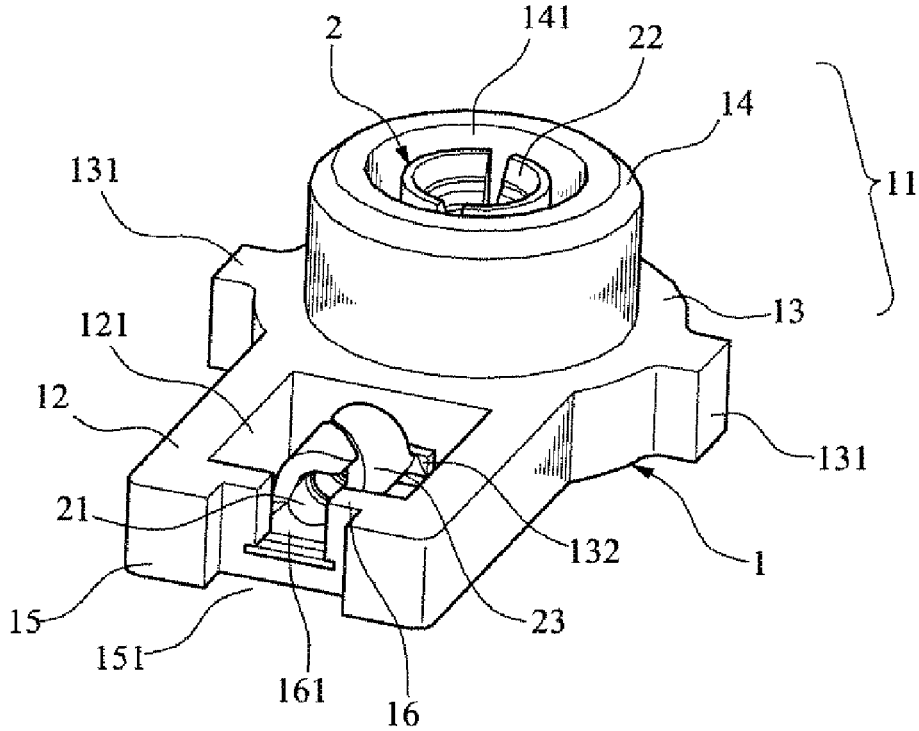
FIG. 3 is a perspective view of the coaxial connector of the present invention, wherein the insulating body and the terminal are formed integrally.

Please refer to FIG. 3. The central terminal 2 and the insulating body 1 are formed to be an integrated assembly by insert molding. The insulating body 1 comprises a cylindrical portion 11 and a plate portion 12, and the cylindrical portion 11 includes a base 13 and a cylinder 14 protruding from the base. The cylinder 14 may have a hollow portion 141 for accommodating the contact 22 of the central terminal 2. The base 13 and the plate portion 12 are connected each other and on the same plane. A pair of convex members 131 are symmetrically disposed at the outer side of the base 13, the convex members 131 are used to fastened in the housing 3, the base 13 may have a penetrating hole 132 cross-linked with the hollow portion 141 such that the main rod 21 of the central terminal 2 may be inserted therein. The plate portion 12 has a hollow portion 121 for accommodating the end fixture 23 of the central terminal 2 and providing the convenience of operation. At the rear end side 15 of the plate portion 12, there is a port 151 formed by the symmetrical cross rods 16 thereon and a receiving groove 161 for communicating with hollow portion 121. The port 151 along with the receiving groove 161 are used to clamp and hold the cable 4 and wires therein. The end portion of the central terminal 2 integrated with insulating body 1 may be inserted against the cross rods 16 to ensure the binding between the central terminal 2 and the insulating body 1 to be more tightly.

Figure 4:
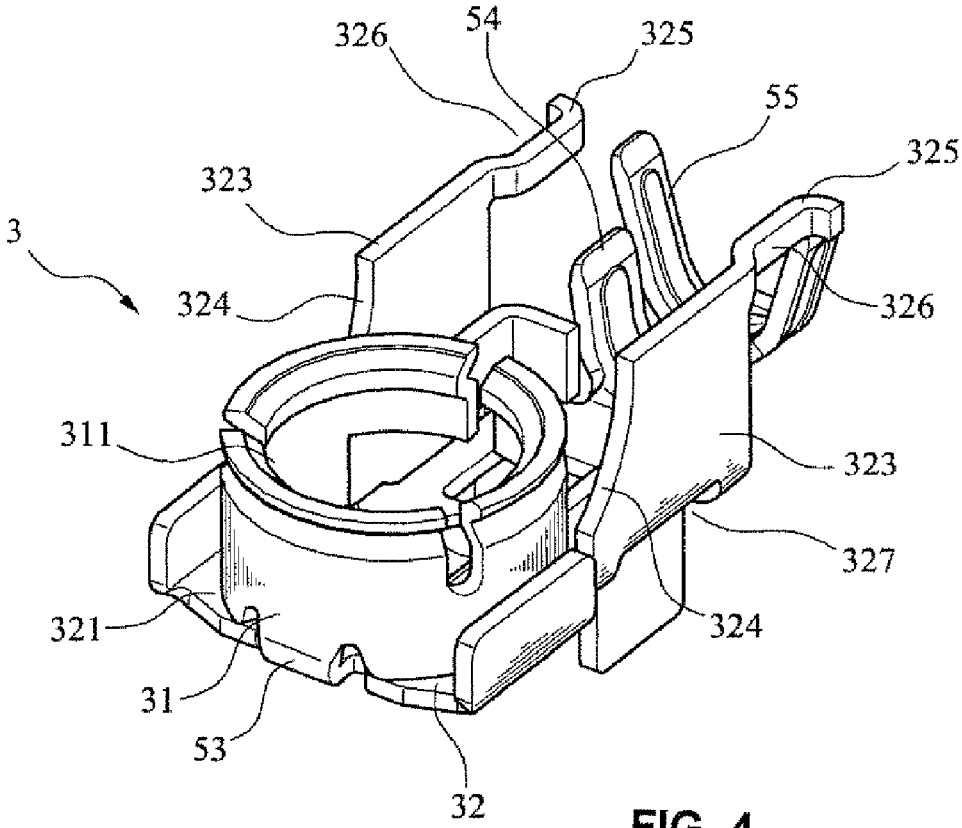
FIG. 4 is a perspective view of the housing of the present invention.
Figure 5:
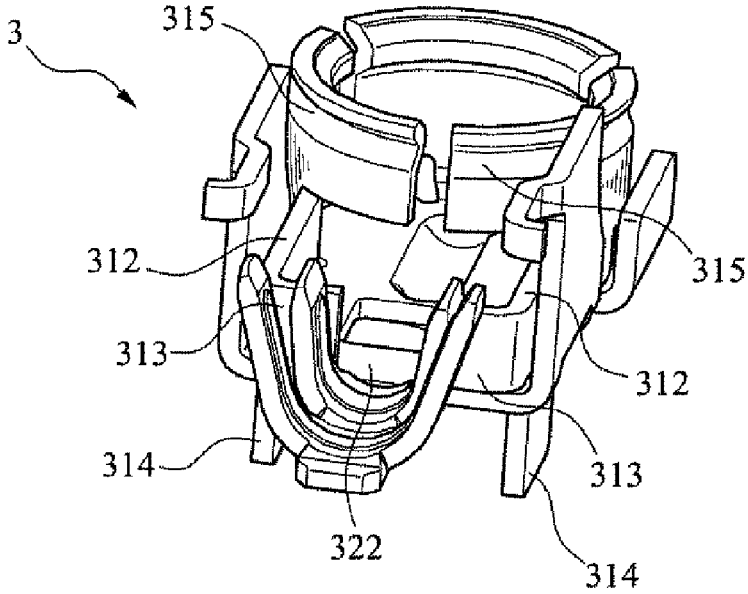
FIG. 5 is a perspective view of the housing of the present invention viewed from another direction.

Please refer to FIGS. 4 and 5. The housing 3 formed integrally from metal sheet by stamping includes a main portion 31, a plate 32 connecting with the main portion 31 and a cable-clamping members positioned at the end of the plate 32. As shown in FIG. 3, the state of the housing 3 is that of the main portion 31 having been bent and folded toward the plate 32. When the housing 3 is formed integrally by stamping, it should be done at the horizontal state (not shown) as the main portion has not yet been bent and folded toward the plate 32.

The main portion 31 may be formed to be cylindrical and have a hollow hole 311 for receiving the cylindrical portion 11 of the insulating body 1. At the end bottom of the main portion 31, a pair of supporting arms 312 are disposed on both sides thereof extended longitudinally along main portion. The ends of the supporting arms 312 facing each other may be bendable inwardly to form stopper 313 for preventing the insulating body 1 from backward movement. The end bottom of each supporting arm 312 may be extended outwardly to form a fixture member 314 for ensuring the tight contact when the main portion 31 is bent toward the plate 32. In addition, there are connecting members 315 disposed above the supporting arms 312 of the main portion 31.

The plate 32 of the housing 3 includes a front portion 321 and a rear portion 322. The front portion 321 being slightly wider than the rear portion 322 is used to receive the cylindrical portion 11 and support main portion 31 after the main portion 31 has been bent and folded toward the plate 32. The rear portion 322 is used to receive the supporting arms 312 of the main portion 31 and plate portion 12. There may be a transition member 53 disposed between the front portion 321 and the main portion 31, which is used to make the bending and folding of the main portion 31 toward plate 32 easier. Both sides of the rear portion 322 may be bendable upwardly and vertically as to form a pair of side arms 323, said side arms 323 being inwardly face to face bent to wrap the insulating body 1 therein to reduce the electromagnetic interference. The front side of each side arm 323 is formed into arc-shaped surface 324 for connecting the outer end of the main portion 31. Said arc-shaped surface may be connected with the outer end of the main portion 31 after the side arms 323 having been bent and folded. The rear side of the side arms 323 may be flat and its upper end may extend outwardly to form a tail part 325. The tail part 325 may be concavity-formed to have a chamfer 326 which is used to match with the first cable-clamping 54, with which the rear portion 322 is connected after mold-stamping. There is a first cable-clamping 54 to tightly bundle the tail part 325 as to reduce the gap of the connecting surface when two side arms 323 are bent inwardly. In addition, a pair of fixture member 314 may be disposed at the borders between the side-rims of the rear portion 322 and the protruded side arms 323 for passing through the inserting ports 327. One end of the rear portion 322 may extend to form a first cable-clamping 54 and a second cable-clamping 55.

Figure 6:
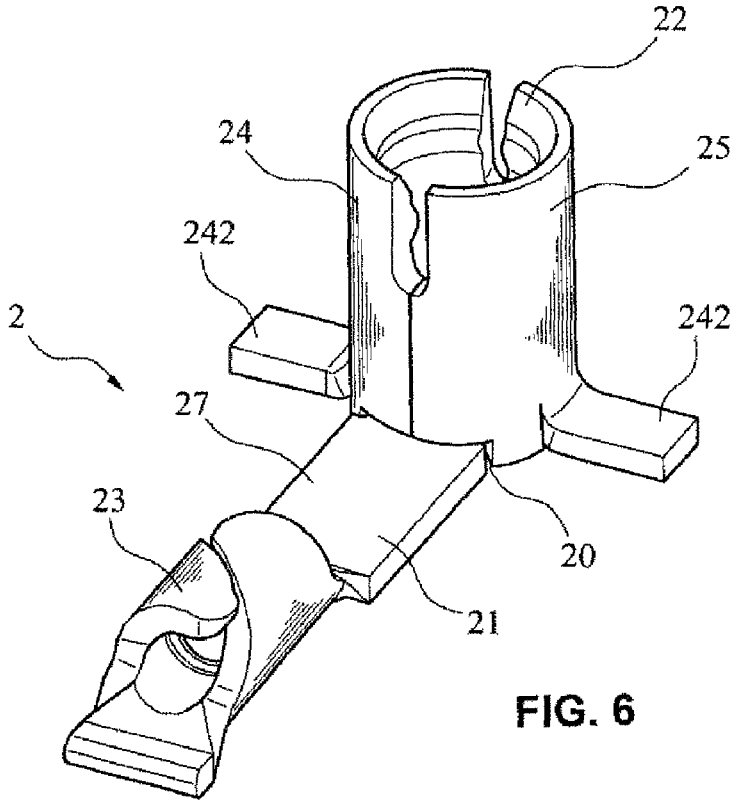
FIG. 6 is a perspective view of the integrated central terminal of the present invention.

Please refer to FIG. 6 showing the final structure of the central terminal 2 after having been bent. The central terminal 2 includes a main rod 21, a contact 22 formed from the co-bending of the left wing-member 24 and the right wing-member 25, and a fixture 23 for clamping and fixing the cable.

Figure 7:
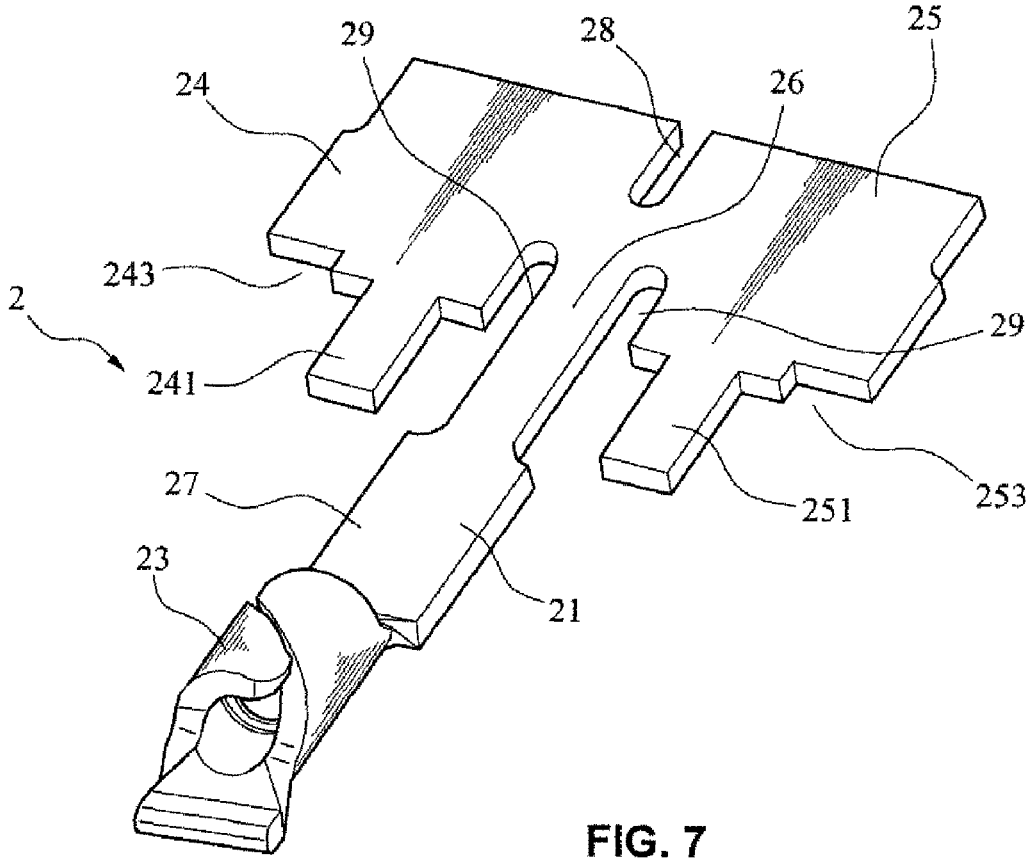
FIG. 7 is an extended perspective view of the central terminal of the present invention.
Figure 8:
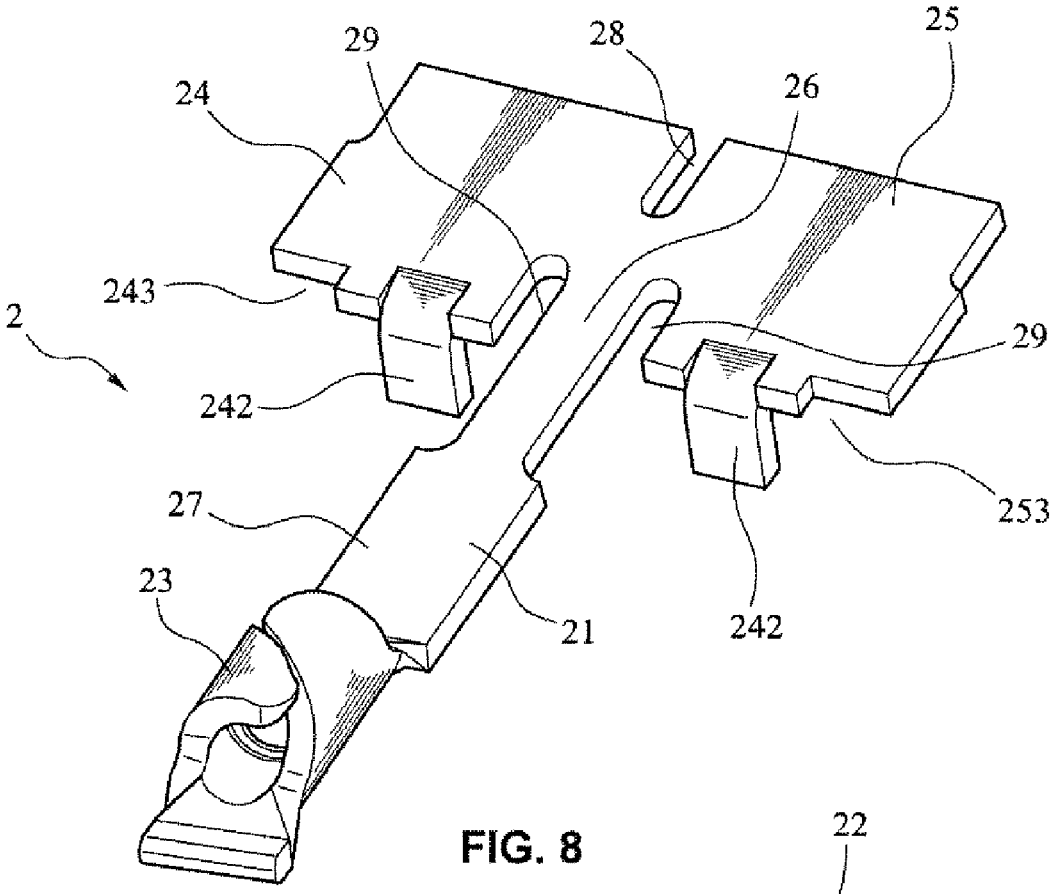
FIG. 8 is a perspective view of the central terminal of the present invention, illustrating the first step of formation.

Please refer to FIG. 7 for the exploded drawing of the central terminal 2. The central terminal 2 primarily comprises a main rod 21 composed of a front portion 26 and a rear portion 27, wherein the front portion 26 is slightly narrower than the rear portion 27. The front portion 26 may have left and right wing-members 24, 25, wherein at their bottom ends extend outwardly to form tongue members 241, 251 respectively, and said tongue members 241, 251 may be torn backwardly, bent downwardly and vertically in order to form a fixing portion 242 for locking and combining the insulating body 1. The fixing portion 242 is used to fasten the insulting body 1 receiving the central terminal 2. FIG. 8 shows the state of the fixing portion 242 after having been bent.

A first notch 28 may be formed at the border of the left and right wing-members 24, 25, and two second notches 29 are formed respectively between the left and right wing-members 24, 25 and the front portion 26, said first and second notches being "U"-shaped. Said cuts 28 and 29 may provide labor-saving effect when the left and right wing-members 24, 25 surrounding the front portion 26 are bent and folded to form the cylindrical contact 22, wherein the second cuts 29 may provide such convenience that makes the contact 22 easily being bent toward the main rod 21. When the left and right wing-members 24, 25 are formed to be a cylinder, there may form a contact 22 for connecting by its periphery onto the matched connector, as shown in FIG. 9.

Figure 9:
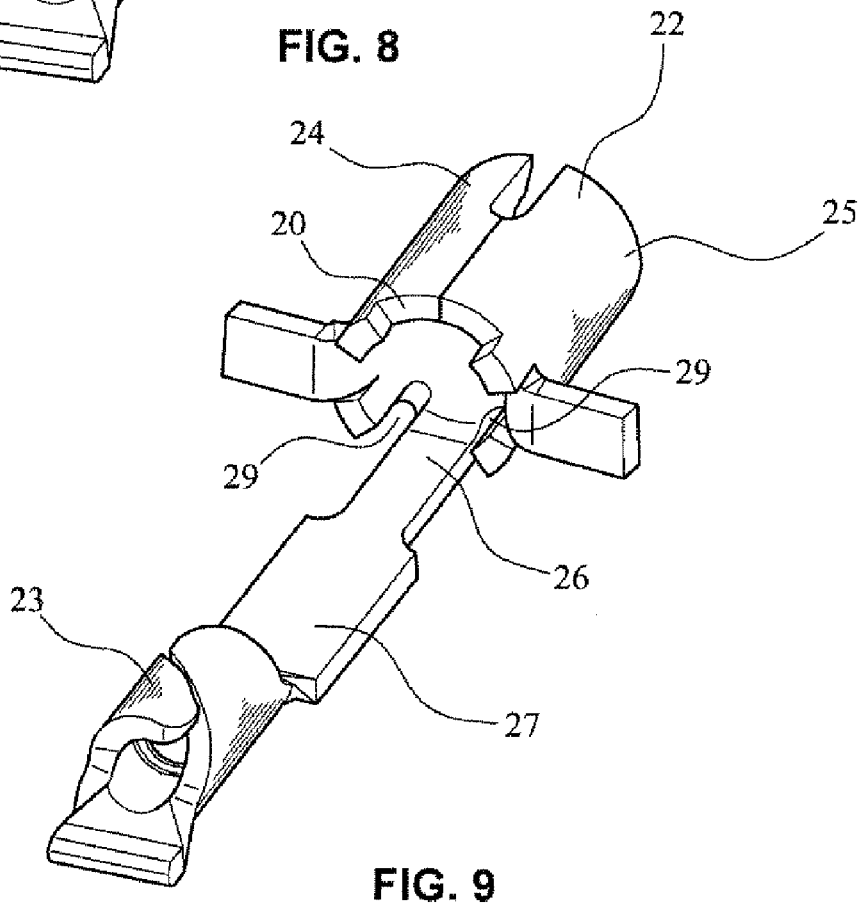
FIG. 9 is a perspective view of the central terminal of the present invention, illustrating the second step of formation.
Figure 10:
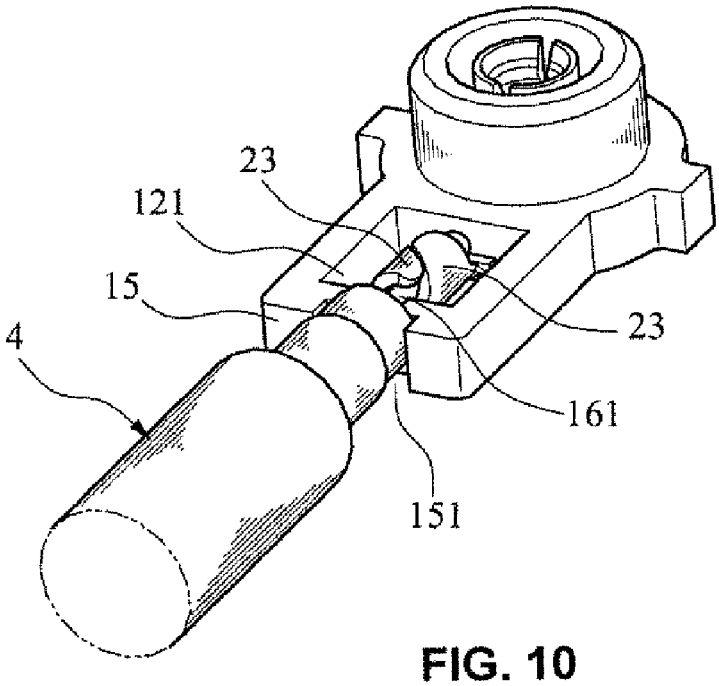
FIG. 10 is a perspective view of the present invention, illustrating the state of clamping the cable.
Figure 11:
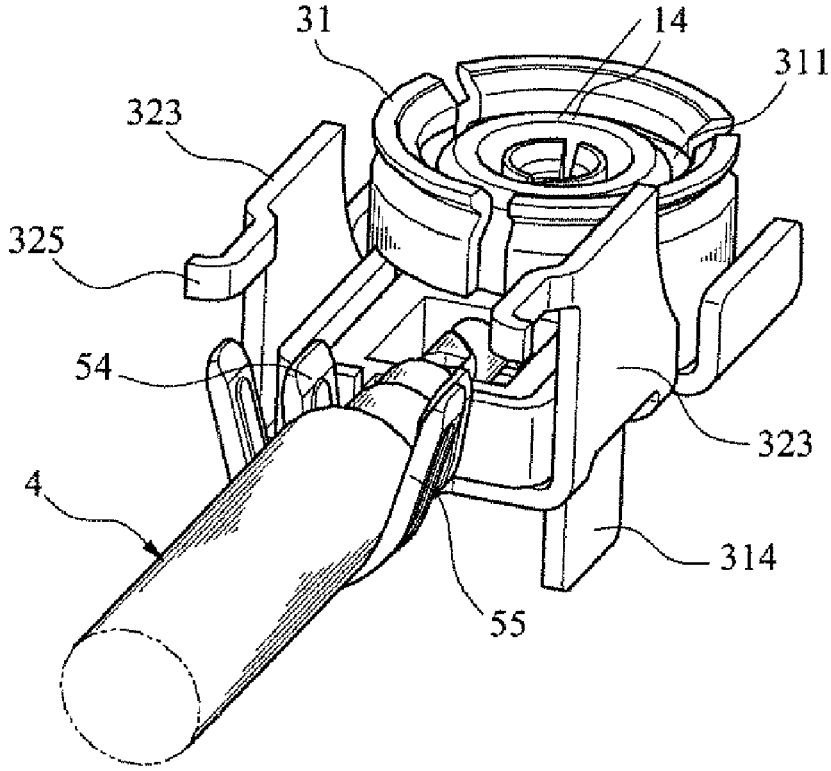
FIG. 11 is a perspective view of the present invention, illustrating the combination of the semi-finished product with the housing.
Figure 12:
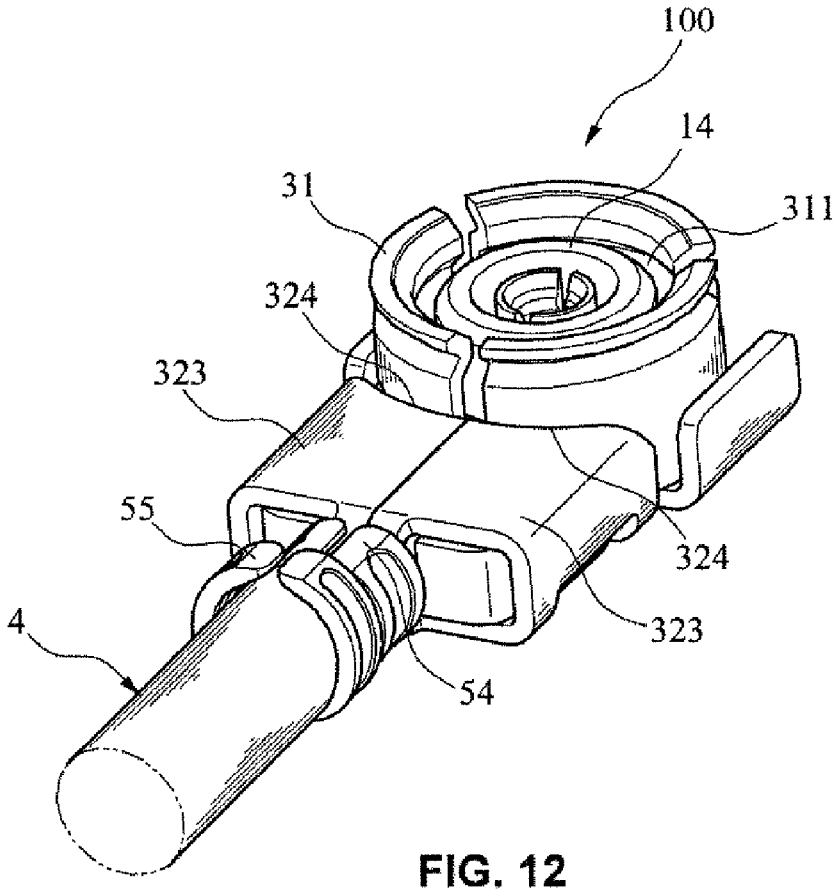
FIG. 12 is a perspective view of the coaxial connector according to the present invention.
Figure 13:
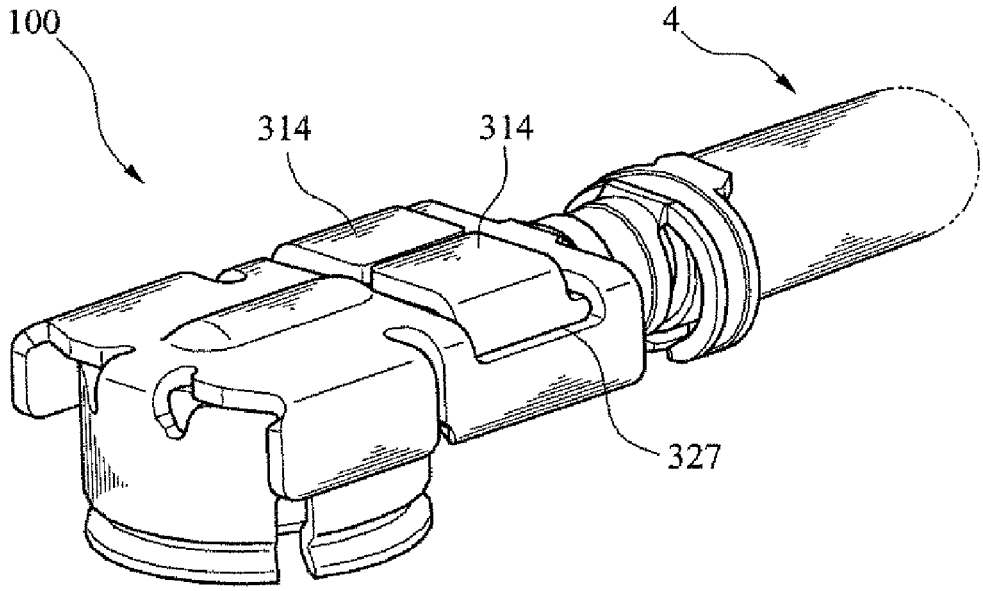
FIG. 13 is an another perspective view of the coaxial connector according to the present invention the present invention.

Further refer to FIGS. 8 and 9, the left and wing-members 24, 25 may have corner cuts 243, 253 at the outer sides of the bottoms thereof, respectively. When the left and right wing-members 24, 25 surround the front portion 26 and are folded to form the contact 22, said two corner cuts 243, 253 may combine to form a concave notch 20 such that when the cylindrical contact 22 is bent and folded toward the main rod 21 and vertical to the front portion 26, the concave notch 20 can be pressed to connect onto the rear portion 27 (as shown in FIG. 6). The rear portion 27 may support the contact 22 to ensure the contact 22 to be in the state of stress balance after being stressed. The contact 22 may cover the front portion 26; the fixture 23 may be disposed on the rear portion 27 for clamping the cable. Said fixture 23 clamps the cable by jigs after the cable is positioned, there is no need to use soldering and therefore may avoid the undesirable troublesome cause by the soldering of the terminals.

Please return to FIG. 6, said central terminal 2 being "L"-shaped after a plurality of bending, and the contact 22 may be cylindrical configuration. Those structures may improve the problems resulting from the manufacture process, improve the connecting effect between the terminal and connector, and enhance the product quality and efficiency of production.

Please refer to FIGS. 3, 10, 11, 12 and 13 respectively, the assembly method of the coaxial connector 100 is described as follow.

In the first step, insert molding is used. Load the stamped central terminal 2 into a pre-shaped mold and then the injection molded insulating body 1 wraps tightly the central terminal 2 as to form an integrated structure without any assembly operation.

In the second step, insert the cable 4 into the integrated structure formed in the first step, said cable 4 has been previously peeled to expose the wires such that the cable 4 may be hold in the port 151, and the wires may be contacted with the fixture 23 of the central terminal 2 through the receiving port 161. Then, insert a jig through the hollow portion 121 of the insulating body 1 to support the end of the central terminal. By means of the stamped fixture 23 with the jig, the fixation of the wires of the cable 4 may be achieved.

In the third step, put the semi-finished product obtained in the second step into the housing 3, wherein the main portion 31 of the housing 3 has not yet been bent and folded toward plate 32. The front portion 321 of the plate 32 may accommodate the cylindrical portion 11 of the insulating body 1, and the rear portion 322 thereof may accommodate the plate portion 12 of the insulating body 1. Then, the main portion 31 is bent and folded toward the plate 32, the supporting arms 312 may be combined with the side arms 323, the fixture members 314 may exactly pass through inserting port 327, a stopper 313 of the supporting arms 312 is against the rear end side 15 to prevent the insulating body 1 from moving backwardly, the convex members 131 of the insulating body 1 may be connected with the inner side of the main portion 31, the connecting member 315 of the main portion 31 may be pressed on the end side of the base 13 for maintaining the balance of the main portion 31.

In the forth step, the fixture member 314 and the side arms 323 of the housing 3 of the semi-finished product obtained in the above-described steps are bent and folded at their predetermined directions, the fixture member 314 can ensure the tight contact when the main portion 31 is bent and folded toward the plate 32, the inwardly-bent side arms 323 may wrap the insulating body 1.

In the fifth step, the first and second cable-clamping 54, 55 of the housing 3 are stamped by using a jig, and the tail portion 325 of the housing 3 is bundled and locked by the first cable-clamping 54 to reduce the gap of the connection surface when two side arms 323 are bent inwardly. Said second cable-clamping 55 may lock and fix the cable 4.

It can be found from the above descriptions that the present invention utilizes an integrally-formed housing for simplifying the manufacture and assembly procedures. In addition, the insulating body and the central terminal are formed by insert molding so that the assembly of the entire coaxial connector only requires a few simple assembly steps combined with stamping. In this way, the assembly process may be standardized, and therefore reduce the defective rate of products, enhance the efficiency of assembly and save the cost of production.

While the invention herein disclosed has been described by means of specific embodiments, numerous modifications and variations could be made thereto by those skilled in the art without departing from the scope and spirit of the invention set forth in the claims.

What is claimed is:

1. A coaxial connector comprising an insulating body (1), a central terminal (2) disposed within the insulating body (1), and a housing (3) surrounding the insulating body (1), wherein:

said insulating body (1) comprises a cylindrical portion (11) and a plate portion (12), wherein said cylindrical portion (11) includes a base (13) and a cylinder (14) protruding from the base (13), said cylinder (14) has a hollow portion (141) for accommodating a contact (22) of the central terminal (2); said base (13) and said plate portion (12) are integrally connected together and are disposed on the same plane; a pair of convex members (131) are symmetrically disposed at the outer side of the base (13), and said convex members (131) are adapted to fasten in the housing (3); said base (13) has a penetrating hole (132) cross-linked with a hollow portion (141) such that the central terminal (2) is inserted therein;

said central terminal (2) comprises a main rod (21), a contact (22) formed by co-bending and folding of a left wing-member (24) with a right wing-member (25), and fixtures (23) for clamping and fixing a cable (4); said main rod (21) comprises a front portion (26) and a rear portion (27), wherein said front portion (26) is slightly narrower than said rear portion (27), and said left and right wing-members (24, 25) connected each other along said front portion (26); each of said left and right wing-members (24, 25) has a tongue members (241, 251) respectively extended outwardly from the bottoms thereof; said tongue members (241, 251) is further bent backwardly and then folded to form a fixing portion (242), which is adapted to fix said insulating body (1) for receiving said central terminal (2) which is inlaid in the insulating body (1);

said housing (3) includes a main portion (31), a plate (32) connecting with said main portion (31) and a cable-clamping member (54,55) positioned at an end of each of said plate (32); wherein said main portion (31) is cylindrical and has a hollow hole (311) for receiving the cylindrical portion (11) of the insulating body (1), and at the end bottom of the main portion (31), a pair of supporting arms (312) on both sides thereof extending longitudinally along main portion (31); an end of each of said supporting arms (312) facing each other bendable inwardly respectively to form a stopper (313) for preventing the insulating body (1) from moving backward; an end of each of the bottoms of said supporting arms (312) extending outwardly respectively to form a fixture member (314) for ensuring a tight contact when the main portion (31) is bent toward the plate (32); said plate (32) of said housing (3) including a front portion (321) and a rear portion (322), wherein said front portion (321), slightly wider than said rear portion (322), is adapted to receive said cylindrical portion (11) therein and support said main portion (31) after said main portion (31) has been bent and folded toward said plate (32), and said rear portion (322) is adapted to receive said supporting arms (312) of said main portion (31) and said plate portion (12); a transition member (53) is disposed between said front portion (321) and said main portion (31), which is adapted to make the bending and folding of the main portion (31) toward plate (32) easier; a side of each of said rear portion (322) is bendable upwardly and vertically respectively so as to form a pair of side arms (323), wherein said side arms (323) are inwardly bent to wrap said insulating body (1) therein; a rear side of each of said side arms (323) are flat and their upper ends extending outwardly to form a tail part (325), wherein said tail part (325) has a chamfer (326) which is adapted to match with the cable-clamping member (54,55) with which the rear portion (322) is connected after mold-stamping; said cable-clamping member (54,55) fastens said tail part (325); a pair of fixture members (314) are disposed at a border locating between two side-rims of said rear portion (322) and the protruded side arms (323) to allow each of an inserting port (327) to pass therethrough.

2. A coaxial connector according to claim 1, wherein at a rear end side (15) of said plate portion (12), a port (151) formed by a symmetrical cross rod (16) thereon and a receiving groove (161) formed for communicating with hollow portion (121), said port (151) along with the receiving groove (161) are adapted to clamp and hold a cable (4) therein.

3. A coaxial connector according to claim 1 wherein each of a connecting member (315) is disposed above the supporting arms (312) of the main portion (31) and is pressed on an end side of the base (13) to maintain a balance of the main portion (31).

4. A coaxial connector according to claim 1, wherein an end portion of the central terminal (2) integrated with the insulating body (1) is inserted against the cross rods (16) to secure said central terminal (2) and said insulating body (1) together.

5. A coaxial connector according to claim 1, wherein a front side of each side arm (323) of the housing (3) is formed into an arc-shaped surface (324) for connecting an outer end of the main portion (31), said arc-shaped surface (324) is connected with the outer end of the main portion (31) after the side arms (323) have been bent and folded.

6. A coaxial connector according to claim 1, wherein said cable-clamping members (54, 55) of the housing (3) comprises a first cable-clamping member (54) and a second cable-clamping member (55).

7. A coaxial connector according to claim 1 wherein said first cable-clamping member (54) fastens in said tail part (325) of said housing (3); and said second cable-clamping member (55) fastens said cable (4).

8. A coaxial connector according to claim 1, wherein a first notch (28) is formed at a border of each of said left and right wing-members (24, 25), and two second notches (29) are formed respectively between said left and right wing-members (24, 25) and the front portion (26), and the first notch (28) and the second notch (29) are U-shaped.

9. A coaxial connector according to claim 1, wherein said left and wing-members (24, 25) each has a corner cut (243, 253) at an outer side of each of the bottoms thereof, respectively, when said left and right wing-members (24, 25) surround said front portion (26) and are folded to form said contact (22), said two corner cuts (243, 253) combine to form a concave notch (20) such that when the cylindrical contact (22) is bent and folded toward the main rod (21) and is perpendicular to the front portion (26), a concave notch (20) is pressed to connect the rear portion (27).

* * * * *